US005156466A

United States Patent [19]

Inagaki et al.

[11] Patent Number: 5,156,466

[45] Date of Patent: Oct. 20, 1992

[54] METHOD AND APPARATUS FOR ADJUSTING THE SPACING BETWEEN HEAD AND PLATEN IN AN IMPACT PRINTER OR THE LIKE

[75] Inventors: Haruhisa Inagaki, Tokyo; Mitsugu Inomata; Fumio Nakao, both of Kawasaki, all of Japan

[73] Assignee: Fujitsu Limited, Kanagawa, Japan

[21] Appl. No.: 599,176

[22] Filed: Oct. 17, 1990

[30] Foreign Application Priority Data

Oct. 18, 1989 [JP] Japan ..... 1-270681
Oct. 18, 1989 [JP] Japan ..... 1-270683

[51] Int. Cl.[5] ..... B41J 11/20

[52] U.S. Cl. ..... 400/56; 400/59; 400/355

[58] Field of Search ..... 400/27, 55, 56, 57, 400/59, 60, 355

[56] References Cited

U.S. PATENT DOCUMENTS 4,043,440 8/1977 Busch ..... 400/614
4,497,588 2/1985 Volke et al. ..... 400/55
5,051,008 9/1991 Honda et al. ..... 400/59

FOREIGN PATENT DOCUMENTS 0151278 9/1983 Japan ..... 400/55
58-153682 9/1983 Japan .
60-212372 10/1985 Japan .
60-212373 10/1985 Japan .
60-259477 12/1985 Japan .
0171377 8/1986 Japan ..... 400/55
0059573 3/1988 Japan ..... 400/55
63-114682 5/1988 Japan .
63-233872 9/1988 Japan .
63-256473 10/1988 Japan .
1-164080 6/1989 Japan .
1-182080 7/1989 Japan .

*Primary Examiner*—Edgar S. Burr
*Assistant Examiner*—Lynn Hendrickson
*Attorney, Agent, or Firm*—Nikaido, Marmelstein, Murray & Oram

[57] ABSTRACT

A printer of the kind having a printing head for printing on a sheet being held against a platen roll by a sheet presser, with both printing head and sheet presser mounted fast to a head carriage which is movable not only in a direction parallel to the axis of the platen roll but also in a direction normal thereto. For adjusting the spacing between the printing head and the platen roll to the thickness of the sheet to be printed upon, a drive motor is coupled to the head carriage via a yieldable clutch. The drive motor is energized first for driving the head carriage toward the platen roll to an extent equal to, or preferably somewhat exceeding, a predetermined stroke of head travel toward and away from the platen roll, in order to positively hold the sheet presser directly against the platen roll, then for driving the head carriage away from the platen roll over said predetermined stroke, then, after the sheet to be printed upon has been introduced between the platen roll and the sheet presser, for driving the head carriage toward the platen roll to an extent equal to or exceeding said predetermined stroke, in order to positively hold the sheet presser against the platen roll via the sheet, and then for driving the head carriage away from the platen roll a variable distance depending upon the thickness of the sheet, in order to provide a required spacing between the printing head and the platen roll.

5 Claims, 5 Drawing Sheets

METHOD AND APPARATUS FOR ADJUSTING THE SPACING BETWEEN HEAD AND PLATEN IN AN IMPACT PRINTER OR THE LIKE

BACKGROUND OF THE INVENTION

Our invention relates generally to printers such as those used in combination with relatively small size computers for the production of so called hard copies and, in particular, to impact printers of the wire dot type having a printing head for printing on a sheet of paper or like material being held against a platen roll. More particularly, our invention pertains to a method of, and means for, adjusting the spacing between the printing head and the platen roll to the thickness of the sheet to be printed upon in printers of the kind defined.

The printers of the class under consideration are usually put to use with sheets of paper of various thicknesses. The spacing between printing head and platen roll must therefore be readily adjustable to the particular thickness of the sheets to be printed upon for the production of high quality printings. This requirement necessarily implies that the printer must be so constructed that the printing head is adjustably movable toward and away from the platen roll, besides being movable back and forth along the axis of the platen roll.

Conventionally, for such adjustable movement of the printing head toward and away from the platen roll, a bidirectional electric motor such as a stepper motor has been coupled via a friction clutch to an eccentric shaft rotatably extending through a head carriage. The rotation of the eccentric shaft has been translated into the travel of the head carriage, with the printing head mounted fast thereon, toward and away from the platen roll. A sheet presser is also mounted fast to the head carriage for pressing the sheet against the platen roll.

For the adjustment of the head-platen spacing the head carriage has been first retracted away from the platen roll into abutment against a limit stop. Then the head carriage has been driven forward until the sheet presser comes to butt on the platen roll via the sheet to be printed upon.

We object to such conventional means for, and conventional method of, adjusting the head-platen spacing for more reasons than one. First, the limit stop that determines the fully retracted position of the printing head has of necessity been formed of a part totally independent of the platen roll, with several other parts interposed therebetween. The limit stop has had to be positioned highly exactly with respect to the platen roll as the conventional method relies on the fully retracted position of the printing head as the reference position for the determination of the head-platen spacing. Such exact placement of the independent limit stop has made the printers of this kind very costly in construction and troublesome in assemblage.

Another objection to the prior art arises when the sheet presser is forced against the platen roll, either directly or via the sheet to be printed upon, by the electric motor coupled to the eccentric shaft via the friction clutch. Then the friction clutch develops a slip until the motor is set out of rotation. The sheet presser has thus been urged against the platen roll under the full driving force of the motor combined with the weights of the printing head, head carriage, eccentric shaft and so forth. Consequently, not only the sheet presser but also the head carriage, eccentric shaft and other parts have been prone to suffer elastic deformation or, in the worst case, permanent displacement. Such deformation or displacement has made it difficult or impossible to accurately adjust the head-platen spacing to the thickness of the sheet.

SUMMARY OF THE INVENTION

We have hereby invented how to accurately adjust the spacing between printing head and platen roll to the thickness of the sheet to be printed upon in printers of the kind defined, without the difficulties encountered heretofore. We have also discovered, in connection with the adjustment of the head-platen spacing, how to avoid the overloading of the sheet presser against the platen roll during the process of such adjustment.

Briefly stated in one aspect thereof, our invention concerns a printer of the type having a printing head for printing on a sheet being held against a platen roll, the printing head being movable not only in a direction parallel to the axis of the platen roll but also in a direction normal to the axis of the platen roll, a sheet presser disposed between the printing head and the platen roll and movable with the printing head in both of said directions, the printing head traveling with the sheet presser a predetermined stroke toward and away from the platen roll, with the sheet presser butting against the platen roll at the end of the travel of the printing head toward the platen roll, and drive means for adjustably moving the printing head and the sheet presser toward and away from the platen roll.

Characteristically, our invention provides a method of adjusting the spacing between the printing head and the platen roll to the thickness of the sheet to be printed upon in the printer of the type outlined above. The method dictates the energization, before the sheet is introduced between platen roll and sheet presser, of the drive means for driving the printing head and the sheet presser toward the platen roll to an extent equal to, or somewhat more than, said predetermined stroke, in order to positively hold the sheet presser against the platen roll regardless of the initial position of the printing head with respect to the platen roll. Then the drive means is reenergized for driving the printing head and the sheet presser away from the platen roll over said predetermined stroke. Then, after the sheet to be printed upon has been introduced between platen roll and sheet presser, the drive means is reenergized for driving the printing head and the sheet presser toward the platen roll to an extent equal to, or somewhat more than, said predetermined stroke, in order to positively hold the sheet presser against the platen roll via the sheet. Then the drive means is reenergized for driving the printing head and the sheet presser away from the platen roll a variable distance depending upon the thickness of the sheet, in order to provide a required spacing between the printing head and the platen roll.

Thus, whatever the initial distance of the printing head may be from the platen roll, the sheet presser can be invariably moved into direct abutment against the platen roll as the drive means is first energized for driving the printing head and the sheet presser toward the platen roll to an extent equal to, or preferably somewhat more than, the head stroke. This initial movement of the sheet presser into abutment against the platen roll serves to establish a reference position of the printing head preparatory to the adjustment of the head-platen spacing. The subsequent retraction of the printing head over the predetermined stroke serves to provide the required spacing between platen roll and sheet presser for the introduction of the sheet therebetween.

It will therefore be appreciated that the method of our invention makes it unnecessary to provide a limit stop of any exact placement for the determination of the retracted position of the printing head. We have thus succeeded in drastically simplifying and making less expensive the construction of the printers of this type. As an additional advantage, the method of our invention can be easily programmed in the electronic control system of the printer for fully automatic adjustment of the head-platen spacing.

Another aspect of our invention concerns means for carrying out the above summarized method of our invention. Such means comprise a head carriage having the printing head and the sheet presser mounted thereto, with the sheet presser disposed between the platen roll and the printing head. Support means support the head carriage in such a way that the head carriage is movable with the printing head and the sheet presser not only in a direction parallel to the axis of the platen roll but also in a direction normal to the axis of the platen roll, the printing head traveling with the sheet presser a predetermined stroke toward and away from the platen roll, with the sheet presser butting against the platen roll at the end of the travel of the printing head toward the platen roll. Drive means are coupled to the head carriage via a yieldable clutch for adjustably moving the printing head and the sheet presser toward and away from the platen roll. The yieldable clutch permits the drive means to run freely when overloaded upon abutment of the sheet presser against the platen roll, either directly or via the sheet to be printed upon.

Also included in the means of our invention are control means for controllably energizing the drive means for causing the same to drive the head carriage toward and away from the platen roll via the yieldable clutch. For the adjustment of the head-platen spacing by the method of our invention, the control means energize the drive means first for driving the head carriage toward the platen roll at least said predetermined stroke before the sheet is introduced between the platen roll and the sheet presser, then for driving the head carriage away from the platen roll over said predetermined stroke, then, after the sheet to be printed upon has been introduced between the platen roll and the sheet presser, for driving the head carriage toward the platen roll at least said predetermined stroke, in order to hold the sheet presser against the platen roll via the sheet, and then for driving the head carriage away from the platen roll a variable distance depending upon the thickness of the sheet, in order to provided a required spacing between the printing head and the platen roll.

Preferably, and as in an embodiment of our invention to be disclosed subsequently, the drive means comprise an electric bidirectional drive motor or like actuator coupled to an eccentric shaft via the yieldable overrunning clutch. The eccentric shaft is supported for rotation about an eccentric axis parallel to the axis of the platen roll and rotatably extends through a hole in the head carriage. The head carriage is therefore driven toward and away from the platen roll as the drive motor imparts bidirectional rotation to the eccentric shaft.

A most pronounced feature of the construction in accordance with our invention is that the drive motor, or any other equivalent actuator, is gravitationally loaded by the weights of the eccentric shaft, the head carriage, the printing head and the sheet presser when driving the head carriage toward the platen roll. Accordingly, when the sheet presser comes into abutment against the platen roll, either directly or via the sheet to be printed upon, the clutch yields with a minimum of motor output torque. No deformation or displacement of the related parts is to occur with such minimum motor torque, so that the head-platen spacing is accurately adjustable to the thickness of the sheet to be printed upon. Moreover, even if printing is to be done on presure-sensitive sheets, such sheets are not to be stained when pressed against the platen by the sheet presser.

The above and other features and advantages of our invention and the manner of realizing them will become more apparent, and the invention itself will best be understood, from a study of the following description and appended claims, with reference had to the attached drawings showing the preferred embodiment of our invention.

DETAILED DESCRIPTION OF THE INVENTION

Figure 1:
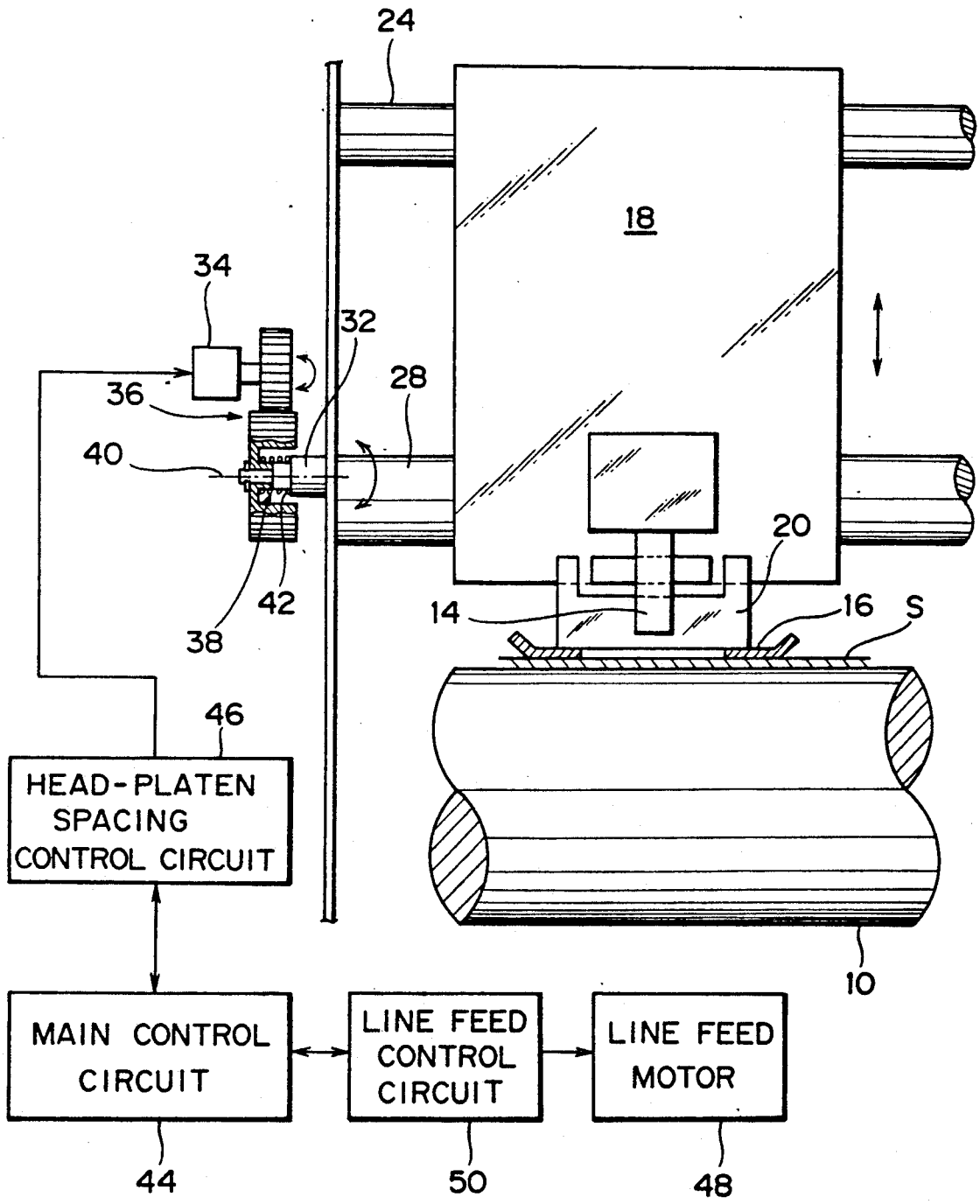
FIG. 1 is a fragmentary plan view of the printer constructed in accordance with the principles of our invention, shown together with a block diagram of the electronic control system of the printer.
Figure 2:
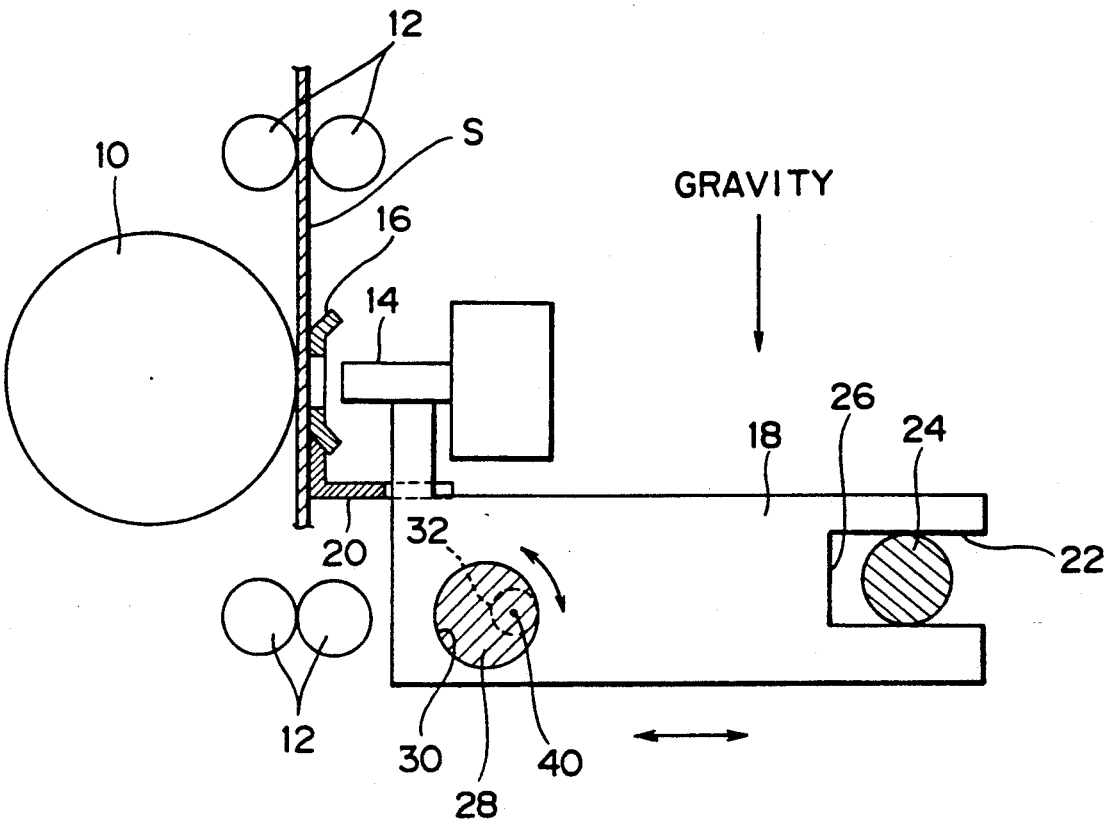
FIG. 2 is a right hand side elevation of the showing of FIG. 1.

We will first describe with reference to FIGS. 1 and 2 the general construction of the printer embodying the principles of our invention. At 10 is seen a platen roll rotatable about a fixed axis extending horizontally. Two pairs of feed rolls 12, FIG. 2, are disposed adjacent the platen roll 10 for feeding thereover a sheet or strip S of paper or like material to be printed upon.

A printing head 14 is disposed opposite the platen roll 10 for printing upon the sheet S being held against the platen roll by a sheet presser 16. The printing head 14 is mounted fast on a head carriage 18. The sheet presser 16 is also secured to the head carriage 18 via a bracket 20.

The head carriage 18 with the printing head 14 and sheet presser 16 thereon must be movable not only along the axis of the platen roll 10 but also in a direction at right angles thereto. Thus, as revealed by FIG. 2, a groove of rectangular shape is cut at 22 in the head carriage 18 for slidably receiving a fixed guide rod 24 extending parallel to the platen axis. The depth of the groove 22 is so much more than the diameter of the guide rod 24 that the head carriage 18 is movable toward and away from the platen roll 10, besides being movable in its longitudinal direction. The bottom 26 of the groove 22 is to butt on the guide rod 24 when the head carriage 18 is retracted too far away from the platen roll 10, so that the guide rod 24 serves also as limit stop for preventing excessive retraction of the head carriage. The travel of the head carriage 18 toward the platen roll 10, on the other hand, is limited by the platen roll itself as the sheet presser 16 butts against the same, either directly or via the sheet S, upon full forward travel of the head carriage.

For such travel of the head carriage 18 toward and away from the platen roll 10 there is employed an eccentric shaft 28 laid parallel to the platen axis and rotatably extending through a hole 30 in the head carriage. The eccentric shaft 28 has an offset extension 32 on one of its opposite ends. This shaft extension 32 is coupled to an electric bidirectional drive motor 34, such as that of the familiar stepper type, via reduction gearing 36 and yieldable clutch 38.

Thus the bidirectional rotation of the drive motor 34 is imparted via the reduction gearing 36 and yieldable clutch 38 to the offset extension 32 of the eccentric shaft 28. The shaft extension 32 rotates about its own axis indicated at 40 in both FIGS. 1 and 2. Accordingly, the eccentric shaft 28 rotates about this eccentric axis 40, with the consequent travel of the head carriage 18 toward and away from the platen roll 10.

We have shown the yieldable clutch 38 as a familiar spring clutch, having for torque delivery a coil spring 42 with its opposite ends anchored respectively to the eccentric shaft extension 32 and to the final member of the reduction gearing 36. When the drive motor 34 is driving the head carriage 18 toward the platen roll 10, the clutch spring 42 will loosen when overloaded, that is, when the sheet presser 16 comes into abutment against the platen roll, either directly or via the sheet S. Then the yieldable clutch 38 will permit the drive motor 34 to rotate even though the eccentric shaft 28 is restrained from rotation. The clutch spring 42 will be loaded in its tightening direction when the drive motor 34 is driving the head carriage 18 away from the platen roll 10, permitting no relative rotation between eccentric shaft 28 and reduction gearing 36.

We have employed the spring clutch 38 by way of example only. A friction clutch or like two-way yieldable clutch could be employed in place of the spring clutch which is a one-way yieldable clutch.

As indicated block-diagrammatically in FIG. 1, the printer is provided with an electronic main control circuit 44 of largely conventional make which can be programmed for automatically controlling all the required printer operations including the adjustment of the head-platen spacing in accordance with our invention. The main control circuit 44 is connected with a head-platen spacing control circuit 46 which controllably energizes the drive motor 34 for adjusting the head-platen spacing according to the thickness of the sheet S by the method of our invention. We have not shown any detailed construction of the head-platen spacing control circuit 46 as it falls outside the scope of our invention. It will be easy for the electronics specialists to device the circuit from known components such as a central processor unit, read-only memory, and random access memory after reading the subsequent discussion of the method of our invention.

The main control circuit 44 is also connected with a line feed motor 48 via a line feed control circuit 50. The line feed motor 48 drives the platen roll 10, as well as the two pairs of sheet feed rolls 12, under the direction of the line feed control circuit 50.

Figure 3:
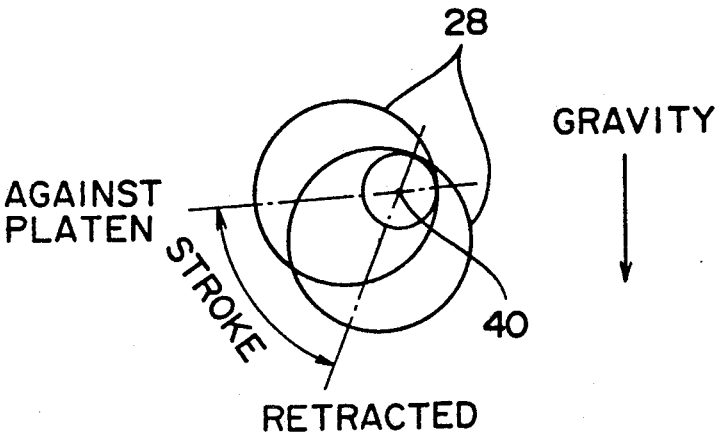
FIG. 3 is a diagram explanatory of the angle of bidirectional rotation of the eccentric shaft in driving the head carriage toward and away from the platen roll in the printer of FIGS. 1 and 2.

FIG. 3 is explanatory of how the eccentric shaft 28 is motor driven bidirectionally to cause the travel of the head carriage 18 toward and away from the platen roll 10. It will be noted from this figure that the eccentric shaft 28 revolves about the axis 40 against gravity for moving the head carriage 18 toward the platen roll 10. Therefore, during such forward travel of the head carriage 18, the drive motor 34 is gravitationally loaded by the masses of all the members on the drive side of the yieldable clutch 38. Such members include, in this particular embodiment, the printing head 14, the sheet presser 16, the bracket 20, the head carriage 18 and the eccentric shaft 28, although the weights of the had carriage and the eccentric shaft may not be totally loaded on the drive motor 34. In other words, the yieldable clutch 38 must transmit the forward torque of the drive motor 34 to the eccentric shaft 28 in opposition to these weights.

An inspection of FIG. 3 will also indicate that the weights of the above listed members combine with the output torque of the drive motor 34 for retraction of the head carriage 18 away from the platen roll 10. The resulting torque on the yieldable clutch 38 during carriage retraction is therefore so much less than if the head carriage 18 were retracted solely by the output torque of the drive motor 34.

Figure 4:
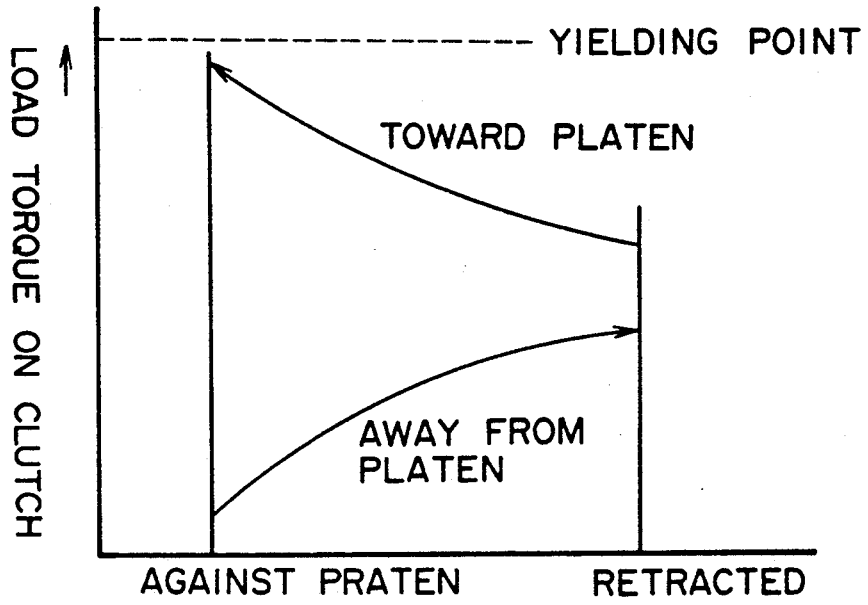
FIG. 4 is a graph plotting the curves of the load torque exerted on the yieldable clutch during the travel of the printing head toward and away from the platen roll.

We have graphically represented in FIG. 4 the load torque exerted on the yieldable clutch 38 during the travel of the head carriage 19 toward and away from the platen roll 10. The load torque on the clutch gradually increases during carriage travel toward the platen and maximizes when the sheet presser 16 becomes pressed against the platen. This maximum torque is close to the predetermined value at which the clutch yields. Therefore, the clutch will actually yield when the sheet presser is pressed against the platen with a minimum of additional motor output torque.

During carriage retraction, on the other hand, the load torque on the clutch is generally far less than that during foward carriage travel. The resulting saving in the energy consumed by the drive motor is sufficient to compensate for the additional power required by the motor for driving the carriage toward the platen in opposition to the weights of the noted parts.

Figure 5:
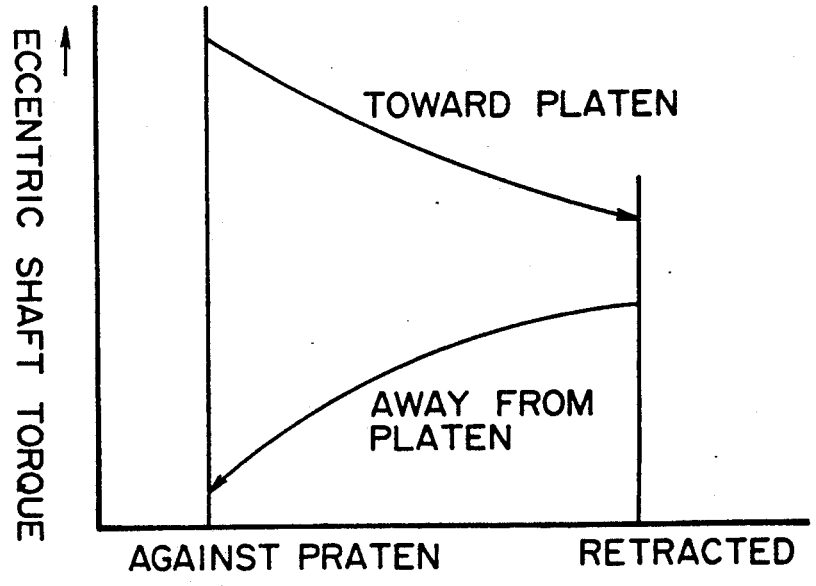
FIG. 5 is a graph plotting the curves of the torque developed by the eccentric shaft during the travel of the printing head toward and away from the platen roll.

FIG. 5 is a graphic representation of the torque developed by the eccentric shaft 28 during carriage travel toward and away from the platen. Owing to the weights of the noted parts the eccentric shaft torque gradually decreases during carriage travel toward the platen and minimizes when the sheet presser becomes held against the platen.

Operation

We will now discuss how the spacing between platen roll 10 and printing head 14 is adjusted to the thickness of the sheet S by the method of our invention. Such discussion will be better understood by referring to the flowchart of FIG. 6 taken together with FIG. 7 which is a diagrammatic illustration of the flowchart.

The adjustment of the head-platen spacing starts before the introduction of the sheet S between platen roll 10 and sheet presser 16. Possibly, the printing head 14 may be situated anywhere between its two predetermined extreme positions closest to, and farthest away from, the platen roll 10 before the adjustment of the head-platen spacing. Therefore, according to the method of our invention, the drive motor 34 is first energized forwardly to an extent necessary for driving the head carriage 18, with the printing head 14 and sheet presser 16 thereon, toward the platen roll 10 a distance (A+a), as indicated at a block 60 in the FIG. 6 flowchart. The capital A represents the predetermined stroke of the head carriage 18, and therefore of the printing head 14, toward and away from the platen roll 10 and is equivalent to the distance at which the presser sheet is to be positioned from the platen roll during the subsequent introduction of the sheet S therebetween. The small letter a represents either zero or, preferably, a distance several times less than the head stroke A.

Thus the distance (A+a) means at least the head stroke A which is predetermined by the angle of rotation of the eccentric shaft 28 about the axis 40, as has been set forth with reference to FIG. 3. We recommend, however, that the distance (A+a) be made longer than the head stroke A, to such an extent that the sheet presser 16 will infallibly hit the platen roll 10 even if the head carriage 18 has been accidentally retracted so much that the bottom 26 of the groove 22 therein butts against the guide rod 24.

Inevitably, therefore, the drive motor 34 will be kept energized for some time after the sheet presser has come into abutment against the platen roll 10. The spring 42 of the yieldable clutch 38 will then yield to the output torque of the drive motor 34, permitting the motor to rotate for the required additional time even though the head carriage 18 stays in the most advanced position. Now the printing head 16 has been set in a reference position when no sheet is introduced between platen roll 10 and presser sheet 16.

As has been stated, the weights of the printing head 14, sheet presser 16, head carriage 18 and eccentric shaft 28, etc., are loaded on the drive motor 34 during the forward travel of the head carriage. The clutch spring 42 will loosen when the sheet presser 16 becomes pressed against the platen roll 10 with a minimum of motor output torque. Accordingly, no part of the drive linkage from motor 34 to sheet presser 16 will suffer deformation or displacement even if the drive motor remains in rotation after the sheet presser has hit the platen.

The next step, indicated by the block 62, is the retraction of the head carriage 18 over the head stroke A. Now the sheet presser 16 has been positioned at the proper distance from the platen roll 10 for the introduction of the sheet S therebetween.

Then, with reference to FIG. 1, the main control circuit 44 may be factory preprogrammed to signal the line feed control circuit 50 for sheet introduction. The line feed control circuit 50 will then respond by causing the line feed motor 48 to rotate a required number of revolutions for introducing and indexing the sheet S between platen roll 10 and sheet presser 16 by the joint rotation of the platen roll 10 and the sheet feed rolls 12. This step is indicated by the block 64 in the FIG. 6 flowchart.

Then the head carriage 18 may be again driven toward the platen roll 10 the distance (A+a), as at the block 66. This time the sheet presser 16 will come into abutment against the platen roll 10 via the sheet S. The clutch spring 42 will again loosen with a minimum of motor output torque after the sheet presser has butted on the platen roll 10 via the sheet S. Now the printing head 14 has been set in a reference position when the sheet S of given thickness is caught between platen roll 10 and sheet presser 16.

Figure 6:
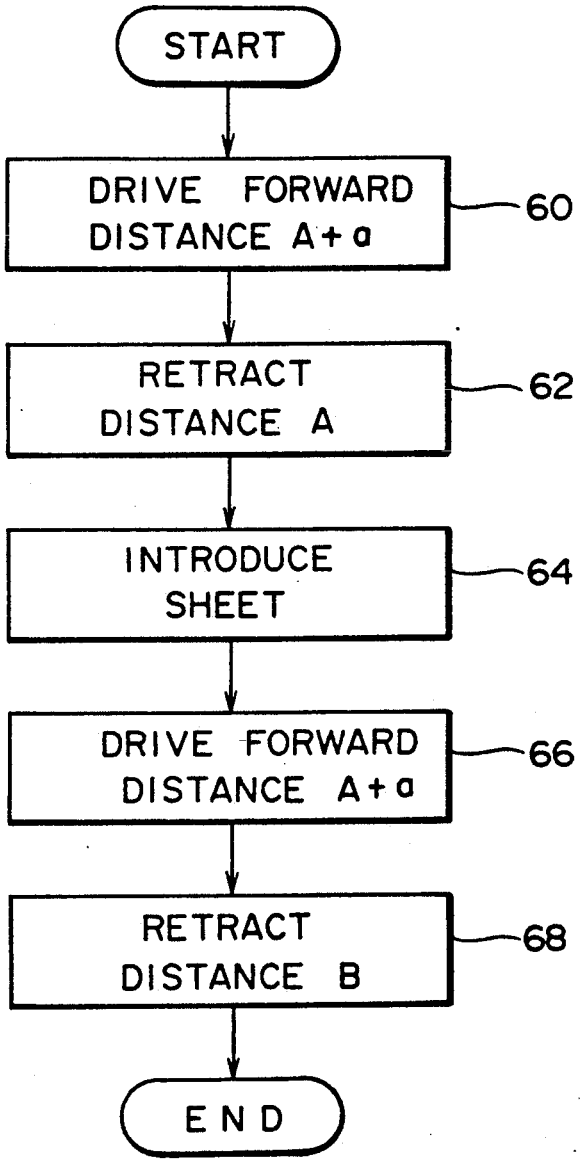
FIG. 6 is a flowchart indicating the steps of adjusting the headplaten spacing by the method of our invention.
Figure 7:
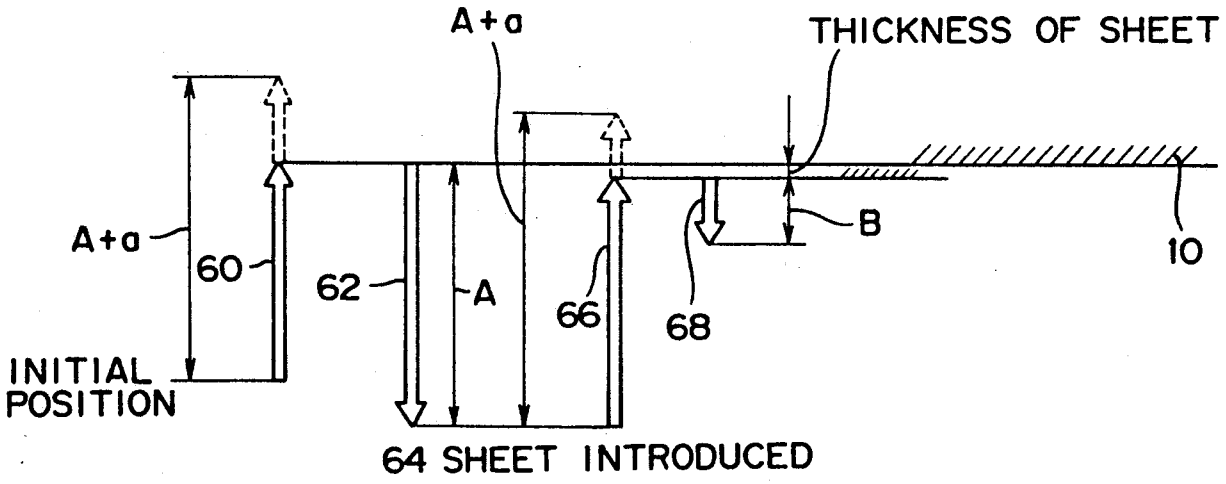
FIG. 7 is a diagram illustrating the steps of the flowchart of FIG. 6.

Then the drive motor 34 may be energized in the reverse direction for retracting the printing head 14 a predetermined distance B, FIG. 7, as at the block 68 in the FIG. 6 flowchart. Now the spacing between platen roll 10 and printing head 14 has been adjusted to any given thickness of the sheet S to be printed upon.

Despite the foregoing detailed disclosure, we do not wish our invention to be limited by the exact details of the illustrated embodiment. For instance, the stepper motor employed in the illustrated embodiment for driving the head carriage could be replaced by any other type or motor or rotary actuator or by a linear actuator in combination with a motion translating mechanism. A variety of additional modifications or adaptations of the foregoing embodiment will suggest themselves to one skilled in the art to conform to design preferences or to the requirements of each specific application of our invention, without departing from the fair meaning or proper scope of the following claims.

What we claim is:

1. In a printer of the type having a printing head for printing on a sheet being held against a platen, the printing head being movable in a direction parallel to an axis of the platen and in a direction normal to the axis of the platen, with a sheet presser disposed between the printing head and the platen and movable with the printing head in both of said directions, the printing head and the sheet presser moving by a first predetermined distance toward and away from the platen, with the sheet presser butting against the platen at the end of the travel of the printing head toward the platen, and drive means for adjustably moving the printing head and the sheet presser toward and away from the platen, a method of adjusting the spacing between the printing head and the platen to the thickness of the sheet to be printed upon, said method comprising:

(a) energizing the drive means, before the sheet is introduced between the platen and the sheet presser, for driving the printing head and the sheet presser toward the platen by at least said first predetermined distance, in order to positively hold the sheet presser against the platen regardless of the initial position of the printing head with respect to the platen;

(b) again energizing the drive means for driving the printing head and the sheet presser away from the platen by said first predetermined distance;

(c) introducing a sheet to be printed upon between the platen and the sheet presser;

(d) again energizing the drive means for driving the printing head and the sheet presser toward the platen by at least said predetermined distance, in order to positively hold the sheet presser against the platen via the sheet; and (e) again energizing the drive means for driving the printing head and the sheet presser away from the platen by a variable distance depending upon the thickness of the sheet, thereby providing a required spacing between the printing head and the platen.

2. The invention of claim 1 wherein: at step (a), the drive means is energized to an extent necessary for driving the printing head and the sheet presser a second predetermined distance exceeding said first predetermined distance.

3. The invention of claim 1 wherein: at step (d), the drive means is energized to an extent necessary for driving the printing head and the sheet presser said second predetermined distance.

4. In a printer of the type having a printing head for printing on a sheet being held by a sheet presser against a platen roll rotatable about a fixed axis, the combination thereof with means for adjusting the spacing between the printing head and the platen roll to the thickness of the sheet to be printed upon, said means comprising:

(a) a head carriage having the printing head and the sheet presser mounted thereto, said sheet presser being disposed between the platen roll and the printing head;

(b) support means for supporting the head carriage in such a way that the head carriage is movable with the printing head and the sheet presser in a direction parallel to the axis of the platen roll and in a direction normal to the axis of the platen roll, the printing head and the sheet presser moving by a predetermined distance toward and away from the platen roll, with the sheet presser butting against the platen roll at the end of the travel of the printing head toward the platen roll;

(c) drive means coupled to the head carriage for adjustably moving the printing head and the sheet presser toward and away from the platen roll;

(d) a yieldable clutch coupled between the drive means and the head carriage for permitting the drive means to run freely when overloaded upon abutment of the sheet presser against the platen roll, either directly or via the sheet to be printed upon;

(e) control means for actuating said drive means in a sequence of movements consisting of driving the head carriage toward the platen roll at least said predetermined distance before the sheet is introduced between the platen roll and the sheet presser, in order to positively hold the sheet presser directly against the platen roll;

(f) driving the head carriage away from the platen roll over said predetermined distance;

(g) driving the head carriage toward the platen roll at least said predetermined distance, after the sheet to be printed upon has been introduced between the platen roll and the sheet presser, in order to positively hold the sheet presser against the platen roll; and (h) driving the head carriage away from the platen roll a variable distance depending upon the thickness of the sheet, thereby providing a required spacing between the printing head and the platen roll.

5. The invention of claim 4 wherein the drive means comprises:

(a) actuator means for providing bidirectional rotary motion; and (b) an eccentric shaft coupled to the actuator means via the yieldable clutch for rotation about an eccentric axis parallel to the axis of the platen roll and rotatably extending through a hole in the head carriage;

(c) the actuator means being gravitationally loaded by the weights of the eccentric shaft, the head carriage, the printing head and the sheet presser when driving the head carriage toward the platen roll.

* * * * *